US009315902B2

(12) United States Patent
Sugiura et al.

(10) Patent No.: US 9,315,902 B2
(45) Date of Patent: Apr. 19, 2016

(54) COMPOSITION FOR CHEMICAL CONVERSION TREATMENT AND METHOD OF MANUFACTURING A MEMBER HAVING A BLACK FILM FORMED FROM THE COMPOSITION

(75) Inventors: Toshihiro Sugiura, Chiryu (JP); Shusaku Ishikawa, Anjo (JP)

(73) Assignee: YUKEN INDUSTRY CO., LTD., Aichi (JP)

( * ) Notice: Subject to any disclaimer, the term of this patent is extended or adjusted under 35 U.S.C. 154(b) by 463 days.

(21) Appl. No.: 12/994,391

(22) PCT Filed: Sep. 28, 2009

(86) PCT No.: PCT/JP2009/066731

§ 371 (c)(1),
(2), (4) Date: Mar. 7, 2011

(87) PCT Pub. No.: WO2010/035819

PCT Pub. Date: Apr. 1, 2010

(65) Prior Publication Data

US 2011/0155286 A1 Jun. 30, 2011

(30) Foreign Application Priority Data

Sep. 29, 2008 (JP) ..... 2008-249756

(51) Int. Cl.

| | |
|---|---|
| ***C23C 22/30*** | (2006.01) |
| ***C23C 22/23*** | (2006.01) |
| ***C23C 22/53*** | (2006.01) |
| *C23C 22/06* | (2006.01) |

(52) U.S. Cl.
CPC ..... *C23C 22/53* (2013.01); *C23C 2222/10* (2013.01)

(58) Field of Classification Search
CPC ..... C23C 2222/10; C23C 22/30
USPC ..... 148/267
See application file for complete search history.

(56) References Cited

U.S. PATENT DOCUMENTS

| | | | | |
|---|---|---|---|---|
| 4,359,348 | A | 11/1982 | Crotty | |
| 7,153,348 | B2 * | 12/2006 | Izaki et al. | 106/14.44 |
| 8,070,886 | B2 * | 12/2011 | Inoue et al. | 148/267 |

FOREIGN PATENT DOCUMENTS

| | | | | |
|---|---|---|---|---|
| EP | 1378585 | A1 | 1/2004 | |
| GB | 2144773 | A | 3/1985 | |
| JP | 63145785 | A | 6/1988 | |
| JP | 06173025 | A | 6/1994 | |
| JP | 2005206872 | A | 8/2005 | |
| JP | 2007154286 | A | 6/2007 | |
| JP | WO 2007/094496 | * | 8/2007 | C23C 22/12 |
| WO | 0220874 | A2 | 3/2002 | |

* cited by examiner

*Primary Examiner* — Lois Zheng
(74) *Attorney, Agent, or Firm* — Hamre, Schumann, Mueller and Larson, P.C.

(57) ABSTRACT

The present invention provide a composition for a chemical conversion treatment capable of forming a chemical conversion film having both an excellent black appearance such that the L-value of the film is 28 even when the film is formed from the composition which has been aged, and good corrosion resistance. The composition is a water-soluble composition and comprising a trivalent chromium-containing substance, a cobalt-containing substance, a sulfur compound, and an organic phosphonate compound consisting of one or more compounds selected from the group consisting of organic phosphonic acids, ions of organic phosphonic acids, and organic phosphonates, and a nickel-containing substance as needed. It is preferable that the content of the trivalent chromium-containing substance be 1 to 10 g/L in chromium content equivalent, that the content of the cobalt-containing substance be 0.1 to 10 g/L in cobalt content equivalent, that the content of the sulfur compound be 0.1 to 10 g/L, and that the content of the organic phosphonate compound be 0.1 to 20 g/L. When the composition further contains a nickel-containing substance, the content in nickel content equivalent is preferably 0.10 to 10 g/L.

23 Claims, No Drawings

COMPOSITION FOR CHEMICAL CONVERSION TREATMENT AND METHOD OF MANUFACTURING A MEMBER HAVING A BLACK FILM FORMED FROM THE COMPOSITION

TECHNICAL FIELD

The present invention relates to a long-life composition for chemical conversion treatment capable of forming a black film on the metallic surface of a member, the film not substantially containing hexavalent chromium which is harmful to the environment, but containing trivalent chromium; a method of producing a member having a black film formed from the composition; and a member formed by the method.

BACKGROUND ART

Recently, the use of hazardous metals such as lead, mercury, cadmium, and hexavalent chromium has been restricted by environmental regulations such as RoHS (Restriction of the Use of Certain Hazardous Substances in Electrical and Electronic Equipment) and ELV (End of Life Vehicles) Regulations.

In accordance with this movement, a chromate film, which is effective as an anticorrosive chemical conversion film for a member having a metallic surface such as a galvanized member, has been formed not by a composition for chemical conversion treatment, which may be referred to below as a chemical conversion treatment solution, using a chromate salt containing hexavalent chromium but by a chemical conversion treatment solution containing trivalent chromium.

Some chemical conversion treatment solutions are capable of forming a chemical conversion film having a black appearance, which may be referred to as a black film. Such chemical conversion treatment solutions are mainly used for treating members and parts for office equipment, electric appliances, and vehicles. Examples of such members include plates, housings, hinges, and press molded parts such as panels. Examples of such parts include fastening parts such as bolts and nuts, and attaching parts such as clumps and clips. However, there is a problem such that chemical conversion treatment solutions are not stable. Therefore, the appearance of a black film formed from a chemical conversion treatment solution, the total area of which is increased, is deteriorated, namely, its appearance becomes gray. The total area of the black film formed from a chemical conversion treatment solution may be referred below to as the total treated area of a chemical conversion film.

In order to overcome the above-described problem, a method of adding a sulfur compound to a chemical conversion treatment solution was proposed, as described in Patent Document 1.

Patent Document 1: JP2005-206872A

DISCLOSURE OF INVENTION

However, as a result of investigations performed by the present inventors, it was found that a chemical conversion treatment solution capable of stably forming a black film having an excellent appearance even when the total treated area was increased could not be obtained merely by adding a sulfur compound to a chemical conversion treatment solution.

Therefore, the object of the present invention is to provide a composition for a chemical conversion treatment, namely, a chemical conversion treatment solution, capable of forming a chemical conversion film having both an excellent black appearance and good corrosion resistance.

The inventors of the present invention investigated how to achieve the above-mentioned object and found that a chemical conversion film containing a specific phosphor compound, namely, an organic phosphonate compound, in addition to a sulfur compound, can form a chemical conversion film having both an excellent black appearance and good corrosion resistance even when the total treated area of the chemical conversion treatment solution is increased.

The present invention was achieved based on the above-mentioned knowledge and is as follows.

According to one aspect of the present invention, there is provided a composition for use in forming a black film having an L value of less than 28 on a metallic surface of a member, the composition comprising a trivalent chromium-containing substance, a cobalt-containing substance, a sulfur compound, and an organic phosphonate compound consisting of one or more compounds selected from the group consisting of organic phosphonic acids, ions of organic phosphonic acids, and organic phosphonates.

An "organic phosphonate compound" is defined as a compound consisting of one or more compounds selected from the group consisting of organic phosphonic acids, ions of organic phosphonic acids, and organic phosphonates. An "organic phosphonic acid" is defined as a compound which consists of a phosphonic group and an organic group bonded with the phosphonic group, and which has a general formula of $R—P(=O)_2$, where R is an organic group.

The L-value is an index of brightness, and particularly a brightness L defined by the Hunter LAB color system. The L-value can be obtained by color measurement performed by an instrument specified by JIS Z8752.

It is preferable that the content of the trivalent chromium-containing substance be 1 to 10 g/L in chromium content equivalent, that the content of the cobalt-containing substance be 0.1 to 10 g/L in cobalt content equivalent, that the content of the sulfur compound be 0.1 to 10 g/L, and that the content of the organic phosphonate compound be 0.1 to 20 g/L.

It is preferable that the composition for chemical conversion treatment according to the present invention further comprise a nickel-containing compound. Namely, the composition preferably comprises a trivalent chromium-containing substance, a cobalt-containing substance, a nickel-containing compound, a sulfur compound, and an organic phosphonate compound.

It is preferable that the content of the trivalent chromium-containing substance be 1 to 10 g/L in chromium content equivalent, that the content of the cobalt-containing substance be 0.1 to 10 g/L in cobalt content equivalent, that the content of the nickel-containing substance be 0.10 to 10 g/L in nickel content equivalent, that the content of the sulfur compound be 0.1 to 10 g/L, and that the content of the organic phosphonate compound be 0.1 to 20 g/L.

The sulfur compound preferably comprises one or more compounds selected from the group consisting of thioglycolic acid, dithioglycolic acid, ions of the acids, and salts of the acids. The organic phosphonate compound preferably comprises one or more compounds selected from the group consisting of (1-Hydroxyethane-1,1-diyl)bisphosphonic acid, 2-phosphonobutane1,2,4-tricarboxylic acid, aminotrimethylenephosphonic acid, ethylenediaminetetramethylenephosphonic acid, diethylenetriaminepentamethylenephosphonic acid, ions of the acids, and salts of the acids.

The L-value of a black film formed from the composition is preferably less than 28 and more preferably at most 26 when the total area of the black film formed from the above-described composition is 1000 $dm^2/L$.

The L-value of a black film formed from the composition is preferably less than 28 and more preferably at most 26 when the composition further comprises an aqueous substance containing zinc and the content of the substance is at most 15 g/L in zinc equivalent.

It becomes difficult for a chemical conversion film formed from a composition for chemical conversion treatment according to prior art to have a black appearance when the content of zinc ions in the composition is at least 2 g/L.

According to another aspect of the present invention, there is provided a liquid composition for preparing the above-described composition.

One example of the liquid composition comprises a trivalent chromium-containing substance having a content of 5 to 150 g/L in chromium content equivalent, a cobalt-containing substance having a content of 0.5 to 200 g/L in cobalt content equivalent, a sulfur compound having a content of s 0.5 to 200 g/L, and an organic phosphonate compound consisting of one or more compounds selected from the group consisting of organic phosphonic acids, ions of organic phosphonic acids, and organic phosphonates having a content of 0.5 to 400 g/L.

Another example of the liquid composition comprises a trivalent chromium-containing substance having a content of 5 to 150 g/L in chromium content equivalent, a cobalt-containing substance having a content of 0.5 to 200 g/L in cobalt content equivalent, a nickel-containing substance having a content of 0.50 to 200 g/L in nickel content equivalent, a sulfur compound having a content of 0.5 to 200 g/L, and an organic phosphonate compound consisting of one or more compounds selected from the group consisting of organic phosphonic acids, ions of organic phosphonic acids, and organic phosphonates having a content of 0.5 to 400 g/L.

According to yet another aspect of the present invention, there is provided a method of producing a member having a black film, the process comprising a step of contacting a metallic surface of a member with the above-described compound so as to form a black film on the surface of the member.

It is preferable that the content of the organic phosphonate compound in the composition increase as the total area of the black film formed from the composition increases.

According to still another aspect of the present invention, there is provided a member having a black film formed by the above-mentioned method.

A black film having both an excellent appearance and good corrosion resistance can be stably achieved by using the chemical conversion treatment solution according to the present invention, even when the total treated area of the solution has increased. Therefore, the chemical conversion treatment solution according to the present invention has a longer life than a chemical conversion treatment solution according to the prior art. Accordingly, it is possible to reduce the volume of the waste liquid generated from chemical conversion treatment and hence to produce a member having a black film on the metallic surface of the member with high productivity.

BEST MODE FOR CARRYING OUT THE INVENTION

I. First Embodiment

1. Composition for Chemical Conversion Treatment

A composition for chemical conversion treatment (a chemical conversion treatment solution) according to a first embodiment is an aqueous composition comprising a trivalent chromium-containing substance, a cobalt-containing substance, a sulfur compound, and an organic phosphonate compound consisting of one or more compounds selected from the group consisting of organic phosphonic acids, ions of organic phosphonic acids, and organic phosphonates. The composition is substantially free from hexavalent chromium.

A chemical conversion film having both an excellent appearance and good corrosion resistance is formed by contacting the chemical conversion treatment solution according to the present embodiment with a member having a metallic surface. Even when the total treated area of the chemical conversion treatment solution has increased, the chemical conversion treatment solution can form a chemical conversion film having an excellent black appearance which is the same as the appearance of a black film formed from an initial chemical conversion treatment solution. Therefore, the length of time until discarding a bath of a chemical conversion treatment solution, namely, the bath life, is longer than the length of time with a chemical conversion treatment solution of the prior art.

The appearance of a black film can be evaluated by measuring the L-value with a commercially available colorimeter specified by JIS Z8722. Generally, the L-value must be less than 28 in order for the film to stably have as a black appearance. The L-value of a chemical conversion film obtained from the chemical conversion treatment solution according to the present invention can be less than 28 even when the total treated area of the chemical conversion treatment solution is 1000 $dm^2/L$.

Each component will be explained below in detail.

(1) Trivalent Chromium-Containing Substance

The chemical conversion treatment solution according to the present embodiment comprises a trivalent chromium-containing substance. The trivalent chromium-containing substance consists of one or more of trivalent chromium and water-soluble substances containing trivalent chromium. A preferable source material for the trivalent chromium-containing substance is a water-soluble compound capable of forming trivalent chromium in water, which may be referred to as a water-soluble trivalent chromium compound.

Examples of a water-soluble trivalent chromium compound include salts of trivalent chromium such as chromium chloride, chromium sulfate, chromium nitrate, chromium phosphate, and chromium acetate, and compounds obtained by reducing hexavalent chromium compounds such as chromic acid and bichromates. The water-soluble trivalent chromium compound may consist of one species or of two or more species. Preferable examples of the water-soluble trivalent chromium compound include chromium chloride and chromium nitrate. Since hexavalent chromium compounds are not intentionally added as source materials to the chemical conversion treatment solution according to the present invention, the chemical conversion treatment solution according to the present invention does not substantially contain hexavalent chromium.

The content of the trivalent chromium-containing substance in the chemical conversion treatment solution is preferably at least 1 g/L in chromium content equivalent from the viewpoint of the stable formation of a chemical conversion film. There is no limitation on the upper limit of the content of the trivalent chromium-containing substance. The content is preferably at most 10 g/L from the viewpoint of high economic efficiency and easy waste treatment. The content of the trivalent chromium-containing substance in the chemical conversion treatment solution is more preferably 2 to 5 g/L from the viewpoint of easy formation of a chemical conversion film.

(2) Cobalt-Containing Substance

The chemical conversion treatment solution according to the present embodiment comprises a cobalt-containing substance from the viewpoint of improving corrosion resistance. The cobalt-containing substance consists of one or more of a cobalt ion and water-soluble substances containing cobalt. A preferable source material of the cobalt-containing substance is a water-soluble compound capable of forming a cobalt ion in water, which may be referred to as a water-soluble cobalt compound.

Examples of a water-soluble cobalt compound include salts of cobalt such as cobalt chloride, cobalt sulfate, cobalt nitrate, cobalt phosphate, and cobalt acetate. The water-soluble cobalt compound may consist of one species or of two or more species.

The content of the cobalt-containing substance in the chemical conversion treatment solution is preferably 0.1 g/L to 10 g/L in cobalt content equivalent. When the content is less than 0.1 g/L, it may become difficult for a chemical conversion film having a black appearance to be obtained. When the content is more than 10 g/L, there is a tendency for the corrosion resistance of a chemical conversion film to decrease. A more preferable content of the cobalt-containing substance in the chemical conversion treatment solution is 0.1 to 5 g/L and an especially preferable content is 0.1 to 3 g/L.

(3) Sulfur Compound

The chemical conversion treatment solution according to the present embodiment comprises a sulfur compound, which is a compound containing sulfur.

Examples of a sulfur compound include sulfurous acid and sulfite, disulfurous acid and disulfite, and a organic or inorganic compound containing a —SH (mercapto group), —S- (thioether group), >C═S (thioaldehyde group, thioketone group), —COSH (thiocarboxy group, —CSSH (dithiocarboxy group), —$CSNH_2$ (thioamide group), and/or —SCN (thiocyanate group, isocyanate group). Examples of such an organic or inorganic compound include ammonium thioglycolate, thioglycolic acid, thiomaleic acid, thioacetamide, dithioglycolic acid, ammonium dithioglycolate, ammonium dithiodiglycolate, dithiodiglycolic acid, cysteine, saccharin, thiamine nitrate, sodium N,N-diethyl-dithiocarbamate, 1,3-diethyl-2-thiourea, N-thiazole-2-sulfuramylamide, 1,2,3-benzotriazole, 2-thiazolin-2-thiol, thiazole, thiourea, thiozole, sodium thioindoxylate, o-sulfonamidobenzoic acid, sulfanilic acid, orange-II, methyl orange, naphthionic acid, naphtalene-alpha-sulfonic acid, 2-mercaptobenzothiazole, 1-naphthol-4-sulfonic acid, Schaeffer's acid (6-hydroxy-2-Naphthalenesulfonic acid), sulfadiazine, ammonium thiocyanate, potassium thiocyanate, sodium thiocyanate, rhodanine, ammonium sulfide, sodium sulfide, ammonium sulfate, thioglycerin, thioacetic acid, potassium thioacetate, thiodiacetic acid, 3,3-thiodipropionic acid, and thiosemicarbazide.

It is preferable from the viewpoint of the stable formation of an excellent black film that the chemical conversion treatment solution contain a sulfur compound comprising one or more compounds selected from the group consisting of thioglycolic acid, dithioglycolic acid, ions of the acids, and salts of the acids.

The sulfur compound is thought to be a component which blackens a chemical conversion film. The content of the sulfur compound is preferably 0.1 to 10 g/L. When the content is less than 0.1 g/L, it becomes difficult for the effect of blackening a chemical conversion film to be obtained. When the content is more than 10 g/L, the effect becomes saturated. A more preferable content of the sulfur compound is 0.3 to 8 g/L and an especially preferable content is 0.5 to 6 g/L.

(4) Organic Phosphonate Compound

The term "organic phosphonate compound" according to the present embodiment is defined as one or more compounds selected from the group consisting of thioglycolic acid, dithioglycolic acid, ions of the acids, and salts of the acids. The term "organic phosphonic acid" is defined as a compound which consists of a phosphonic group and an organic group bonding with the phosphonic group. It has a general formula R—P(═O)$_2$, where R is an organic group.

Examples of an organic phosphonate compound include (1-Hydroxyethane-1,1-diyl)bisphosphonic acid, 2-Phosphonobutane1,2,4-tricarboxylic acid, aminotrimethylenephosphonic acid, ethylenediaminetetramethylenephosphonic acid, and diethylenetriaminepentamethylenephosphonic acid. Examples of salts of the above-described acids include tetrasodium (1-Hydroxyethane-1,1-diyl)bisphosphonate, trisodium (1-Hydroxyethane-1,1-diyl)bisphosphonate, pentasodium ethylenediaminetetramethylenephosphonate, and heptasodium diethylenetriaminepentamethylenephosphonate. Sodium ions are separated from organic phosphonate ions in a chemical conversion treatment solution.

Since the above-described organic phosphonate compound is contained in a chemical conversion treatment solution, a chemical conversion film having a black appearance is formed even from a chemical conversion treatment solution which is increased in total treated area, namely, from a chemical conversion treatment solution which has been aged. Therefore, a chemical conversion treatment solution with a long life can be achieved.

The reason why the chemical conversion treatment solution according to the present invention can form a black film even when the solution has been aged is not clear. Since other compounds containing phosphorus such as orthophosphoric acid, pyrophosphoric acid, tripolyphosphoric acid, phosphorous acid, and hypophosphorous acid do not have a marked effect of inhibiting the deterioration of the black appearance of a chemical conversion film, the effect obtained from a organic phosphonate compound, as shown in the Examples described below, a specific moiety of an organic phosphonate compound rather than the other compounds containing phosphorus is thought to be involved with the fact that the chemical conversion treatment solution according to the present invention can form a chemical conversion film having a black appearance over a long period of time. In particular, an organic phosphonate compound may have characteristics such that this compound can have an interaction with a component which blackens or promotes the blackening of the appearance of a chemical conversion film or with a component which inhibits blackening of the appearance of a chemical conversion film, Because of this interaction, the chemical conversion treatment solution according to the present invention may have a capability of forming a chemical conversion film having a black appearance over a long period of time.

When members having a zinc-type plating are treated with a chemical conversion treatment solution, zinc is eluted from the zinc-type platings during chemical conversion treatment and zinc is accumulated in the chemical conversion treatment solution. The term "zinc-type plating" is a generic name for a zinc plating, a zinc alloy plating, and a product obtained by alloying zinc plating or zinc alloy plating. When the total treated area of a chemical conversion treatment solution is 1000 $dm^2$/L, the zinc content in the chemical conversion treatment solution becomes about 15 g/L.

The deterioration of the black appearance of a chemical conversion film is effectively inhibited by increasing the content of the organic phosphonate compound as the zinc content of a chemical conversion treatment solution increases, namely, as the total treated area of a chemical conversion solution increases. Based on this fact, zinc is thought to be one factor inhibiting the blackening of the appearance of a chemical conversion film.

There is a possibility that an organic phosphonate compound interferes with the function of zinc as a factor inhibiting the blackening of the appearance of a chemical conversion film by a chemical interaction with zinc in a chemical conversion treatment solution.

On the other hand, bisodium EDTA, which has strong chelating properties, does not have the effect obtained from an organic phosphonate compound of inhibiting the deterioration of the black appearance of a chemical conversion film. Based on this fact, it is understood that the organic phosphonate compound has a function beyond a chelating function.

The content of the organic phosphonate compound is preferably 0.1 to 20 g/L. When the content is less than 0.1 g/L, it may become difficult for a chemical conversion film having a black appearance to be stably formed from an aged chemical conversion treatment solution. When the content is more than 20 g/L, the above-described effect is saturated and there is concern of the disadvantageous side-effects of decreasing the stability of a chemical conversion treatment solution and forming compounds which inhibit blackening of the appearance of a chemical conversion film, although the potential of developing the side-effects varies depending on the species of the organic phosphonate compound contained in the chemical conversion treatment solution. The content of the organic phosphonate compound is more preferably 0.2 to 15 g/L and especially preferably 0.3 to 10 g/L so as to stably obtain the black appearance of a chemical conversion film with high productivity.

As described above, the content of the organic phosphonate compound in the chemical conversion treatment solution may be increased as the total area of the black film formed from the solution increases. The specific method of increasing the content of the organic phosphonate compound as the total treated area of the chemical conversion treatment solution increases cannot be specified definitively, because the method varies depending on the composition of the chemical conversion treatment solution and the like. Examples of the method include a method in which the content of the organic phosphonate compound is controlled so as to be 0.3 g/L when a chemical conversion treatment solution is prepared, so as to be 1.5 g/L when the total treated area is 50 $dm^2$/L, and so as to be 4 g/L when the total treated area is 1000 $dm^2$/L.

From the viewpoint of obtaining both an excellent black appearance and good corrosion resistance, the ratio of the content of the sulfur compound to the content of the organic phosphonate compound, which may be referred to as the S/P ratio, is preferably about 0.1 to about 10 and more preferably 0.3 to 6.

(5) Other Components

The chemical conversion treatment solution according to the present invention can also contain one or more compounds selected from the group consisting of metal ions, an organic acid and an anion of the organic acid, an inorganic acid and an anion of the inorganic acid, an inorganic colloid, a silane coupling agent, a nitrogen compound, and a fluorine compound. The chemical conversion treatment solution can further contain one or more compounds selected from the group consisting of a polymer such as a wax, a corrosion inhibitor, a surfactant such as a diol, a triol, and an amine, a plastic dispersive material, a colorant, a pigment, a pigment-producing agent such as a metal pigment-producing agent, a desiccant, and a dispersant. The chemical conversion treatment solution may contain a chemical substance such as a polyphenol capable of reducing the amount of eluted hexavalent chromium from a chemical conversion film.

Examples of a metal ion include ions of Ni, Na, K, Ag, Au, Ru, Nb, Ta, Pt, Pd, Fe, Ca, Mg, Zr, Sc, Ti, V, Mn, Cu, Zn, Sn, Y, Mo, Hf, Te, and W. The metal ion can exist in the form of an oxygen acid ion such as a vanadate ion or tungstate ion. It is preferable that Ni ions and/or Te ions be contained.

When the surface of a member, on which chemical conversion treatment is performed with a chemical conversion treatment solution comprises a material containing zinc, water-soluble substances containing zinc such as zinc ions and complex compounds containing zinc are accumulated in the chemical conversion treatment solution as the total treated area of the chemical conversion treatment solution increases. Generally, when the content of water-soluble substances containing zinc in the zinc content equivalent, which may be referred to as a zinc content, is increased in a chemical conversion treatment solution, it becomes difficult for the chemical conversion treatment solution to form a chemical conversion film having a black appearance. However, the chemical conversion treatment solution according to the present embodiment can form a chemical conversion film having an excellent black appearance even when the zinc content in the chemical conversion treatment solution is 15 g/L. Therefore, the chemical conversion treatment solution according to the present invention can contain water-soluble substances containing zinc as long as the zinc content is at most 15 g/L.

Examples of an organic acid include a monocarboxylic acid such as formic acid, acetic acid, and propionic acid; a dicarboxylic acid such as oxalic acid, malonic acid, succinic acid, glutaric acid, adipic acid, pimelic acid, suberic acid, azelaic acid, sebacic acid, maleic acid, phthalic acid, and terephthalic acid; a tricarboxylic acid such as tricarballylic acid; a hydroxycarboxyl acid such as glycolic acid, lactic acid, malic acid, tartaric acid, citric acid, and ascorbic acid; and an aminocarboxylic acid such as glycine and alanine. Examples of preferable organic acids include a dicarboxylic acid such as oxalic acid and malonic acid.

Examples of an inorganic acid include a halogen acid such as hydrochloric acid, hydrofluoric acid, and hydrobromic acid, chloric acid, perchloric acid, chlorite acid, hypochlorous acid, sulfuric acid, sulfurous acid, nitric acid, and nitrous acid. Inorganic acids containing phosphorus such as phosphoric acid (orthophosphoric acid), polyphosphoric acid, metaphosphoric acid, pyrophosphoric acid, ultraphosphoric acid, hypophosphorous acid, and perphosphoric acid may be contained.

The contents of the above-described acids and/or anions of the acids are not limited. Generally speaking, the ratio of the total molar content of the above-described acids and anions of the acids to the total molar content of trivalent chromium and the above-described metal ions is in the range of 0.1 to 10, and it is preferable that the ratio be in the range of 0.5 to 3.

Examples of an inorganic colloid include a silica sol, an alumina sol, a titanium sol, and a zirconium sol. Examples of a silane coupling agent include vinyltriethoxy silane and gamma-metacryloxypropyltrimethoxy silane.

Examples of a nitrogen compound include organic nitrogen compounds such as heterocyclic compounds such as pyrrole, urea compounds, aliphatic amines, acid amides, aminocarboxylic acids, amines, and nitrobenzenesulfonic acid; and inorganic nitrogen compounds such as urea, ammonium salts, and nitrates. The preferable content of such nitrogen compounds is 0.5 to 50 g/L.

(6) Solvent, pH

A solvent of the chemical conversion treatment solution according to the present embodiment consists mainly of water. From the viewpoint of improving the solubility of components of the chemical conversion treatment solution and particularly the organic phosphonate compound, the solvent may contain an organic solvent which is soluble in water, such as alcohols, ethers, and esters. There is no limitation on the ratio of the amount of the contained organic solvent to the total amount of the solvent. From the viewpoint of easy effluent treatment, the ratio is preferably at most 10% by weight.

There is no limitation on the pH of the chemical conversion treatment solution according to the present embodiment as long as the solution is acidic. The pH is preferably 1 to 4 and especially preferably 2 to 3 from the viewpoint of the high stability of the chemical conversion treatment solution. The pH of a chemical conversion treatment solution may be adjusted by adding alkaline substances such as sodium hydroxide, sodium hydrogen carbonate, and ammonia; and/or acidic substances such as sulfuric acid, nitric acid, and hydrochloric acid.

(7) Method of Treatment and Treatment Conditions

The method of producing a member having a black film by employing the chemical conversion treatment solution according to the present embodiment will be explained below.

First, a member having a metallic surface is contacted with the chemical conversion treatment solution according to the present embodiment. There is no limitation on specific means for contact. The member having a metallic surface may be immersed into a bath of the chemical conversion treatment solution according to the present embodiment, or the chemical conversion treatment solution may be sprayed on the member.

The conditions for the contacting procedure cannot be specified definitively, because the conditions vary depending on the composition of the chemical conversion treatment solution and properties required by a chemical conversion film formed from the chemical conversion treatment solution. When the conditions are excessively mild so that the temperature of the chemical conversion treatment solution is too low and/or the length of time during contact of the solution with the member is too short, the formation of a chemical conversion film becomes insufficient. When the conditions are excessively severe so that the temperature of the solution is too high and/or the length of time during the contact is too long, the formation of a chemical conversion film is saturated and by-products are formed which may shorten the life of the solution and may contaminate a chemical conversion film. The conditions are properly determined so as to avoid these problems. Typically, the temperature of the chemical conversion treatment solution is in the range from 15 to 60 degrees C. and the length of time during the contact is about 5 to 60 seconds, which may vary depending on the temperature of the chemical conversion treatment solution.

Next, the member is washed after contact with the chemical conversion treatment solution, the member is dried after washing, and a member having a black film on the metallic surface of the member is obtained. The conditions for washing and drying are the same as the conditions for common chemical conversion treatment.

2. Liquid Composition for Preparing the Chemical Conversion Treatment Solution

It is preferable to prepare an aqueous liquid composition which is 5 to 20 times as concentrated as the above-described chemical conversion treatment solution. The concentrated solution, which may be referred to below as a dense solution for chemical conversion treatment, is advantageous because a dense solution does not require weighing each component separately and is easy to store. When the dense solution for chemical conversion treatment is prepared, the upper limit on the content of the dense solution is determined in view of the solubility of each component in the dense solution. Specifically, a composition comprising the above-described trivalent chromium-containing substance having a content of 5 to 150 g/L in chromium content equivalent, the above-described cobalt-containing substance having a content of 0.5 to 200 g/L in cobalt content equivalent, the above-described sulfur compound having a content of 0.5 to 200 g/L, and the above-described organic phosphonate compound having a content of 0.5 to 400 g/L, can easily provide the above-mentioned chemical conversion treatment solution in which the content of the trivalent chromium-containing substance is 1 to 10 g/L in chromium content equivalent, the content of the cobalt-containing substance is 0.1 to 10 g/L in cobalt content equivalent, the content of the nickel-containing substance is 0.10 to 10 g/L in nickel content equivalent, the content of the sulfur compound is 0.1 to 10 g/L, and the content of the organic phosphonate compound is 0.1 to 20 g/L by a proper preparation procedure. When the dense solution for chemical conversion treatment contains all of the above-described four components and further contains all of the other components which are added as needed, the procedure for preparing the composition comprises a process of diluting the dense solution an appropriate number of times, such a five times, with a prescribed solvent, which may normally be water. When the dense solution consists of two or more solutions, the preparing procedure comprises a process of diluting each dense solution an appropriate number of times with a prescribed solvent and mixing the diluted solutions, or a process of adding each dense solution to a solvent of a prescribed volume so as to dilute each dense solution.

3. Member for Chemical Conversion Treatment

There is no limitation on a member on which chemical conversion treatment is performed as long as the surface of the member comprises a metal so that the black film of the present embodiment can be formed on the surface of the member. The surface of the member preferably consists of a metal containing zinc. The member especially preferably consists of a steel plate on which a zinc-type plating is formed. The zinc-type plating may consist only of zinc, or it may consist of a zinc alloy, which contains aluminum, for example. The zinc-type plating may be formed by electroplating, hot-dip plating, or hot-dip plating followed by alloying.

After forming a chemical conversion film with the chemical conversion treatment solution according to the present embodiment, the member having the chemical conversion film may be treated with a finishing agent so as to improve corrosion resistance and/or dent resistance.

II. Second Embodiment

As a second embodiment, the present invention provides a composition for chemical conversion treatment, namely, a composition for use in forming a black film on a member having a metallic surface, the composition comprising a trivalent chromium-containing substance, a cobalt-containing substance, a nickel-containing compound, a sulfur compound, and an organic phosphonate compound.

The terms "trivalent chromium-containing substance", "cobalt-containing substance", "sulfur compound", and "organic phosphonate compound" have been already defined in the first embodiment.

The chemical conversion treatment solution according to the present embodiment comprise a nickel-containing substance from the viewpoint of improving corrosion resistance. The nickel-containing substance consists of one or more of a nickel ion and water-soluble substances containing nickel. A preferable source material of the nickel-containing substance is a water-soluble compound capable of forming a nickel ion in water, which may be referred to as a water-soluble nickel compound.

Examples of a water-soluble nickel compound include salts of nickel such as nickel chloride, nickel sulfate, nickel nitrate, nickel phosphate, and nickel acetate. The water-soluble nickel compound may consist of one species or of two or more species.

The content of the nickel-containing substance in the chemical conversion treatment solution is preferably 0.10 g/L to 10 g/L in nickel content equivalent. When the content is less than 0.10 g/L, it may become difficult for a chemical conversion film having a black appearance to be obtained. When the content is more than 10 g/L, there is a concern of a decrease in corrosion resistance of a chemical conversion film. The content of the nickel-containing substance is more preferably 1 to 6 g/L and especially preferably 1 to 3 g/L.

Preferable contents of the trivalent chromium-containing substance, sulfur compound, and the organic phosphonate compound are the same as the preferable contents of these substances explained in the first embodiment. A preferable content of the cobalt-containing substance is also the same as the content of a cobalt-containing substance explained in the first embodiment, and the total content of the cobalt-containing substance in cobalt content equivalent and the content of the nickel-containing substance in nickel content equivalent are preferably 0.50 to 20 g/L in view of obtaining a chemical conversion film having an excellent black appearance, because the function of nickel is similar to the function of cobalt.

The S/P ratio (the ratio of the content of the sulfur compound to the content of the organic phosphonate compound) of the chemical conversion treatment solution according to the second embodiment is preferably about 0.05 to about 2 and more preferably about 0.1 to about 1.2. As explained above, the S/P ratio of the chemical conversion treatment solution according to the second embodiment is preferably lower than the S/P ratio of the chemical conversion treatment solution according to the first embodiment.

Substances capable of being contained in the chemical conversion treatment solution according to the second embodiment in addition to the above-described components, a solvent, the pH, a method of treatment and treatment conditions, and a member for chemical conversion treatment for the second embodiment are the same as for the first embodiment.

As in the first embodiment, it is preferable to prepare a dense solution for the chemical conversion treatment solution according to the second embodiment. Examples of such a dense solution include a liquid composition comprising the trivalent chromium-containing substance having a content of 5 to 150 g/L in chromium content equivalent, the cobalt-containing substance having a content of 0.5 to 200 g/L in cobalt content equivalent, the nickel-containing substance having a content of 0.50 to 200 g/L in nickel content equivalent, the sulfur compound having a content of 0.5 to 200 g/L, and the organic phosphonate compound consisting of one or more compounds selected from the group consisting of organic phosphonic acids, ions of organic phosphonic acids, and organic phosphonates having a content of 0.5 to 400 g/L.

EXAMPLES

Although the present invention will be concretely described below with respect to examples, the invention should not be considered as being in any way limited to these examples.

A compound containing phosphorus, examples of which include organic phosphonate compounds, or an organic compound having a chelating function was added to a chemical conversion treatment solution capable of forming a black film. Chemical conversion treatment was performed with each prepared chemical conversion treatment solution, and the change in the black appearance of a formed film when the total treated area of the chemical conversion treatment solution was increased was measured.

(1) Preparation of Test Plates

Preparation of Test Plates Will be Explained Below.

Chemical conversion treatment solutions, each of which had a composition shown in Tables 1 to 6, were prepared so that each solution has a pH of 2.2 by using nitric acid and sodium hydroxide. A water-soluble trivalent chromium compound used in the preparation of the solutions was chromium nitrate, chromium chloride, chromium sulfate, or chromium acetate. A water-soluble cobalt compound and a water-solube nickel compound used in the preparation of the solutions were cobalt nitrate hexahydrate and nickel sulfate hexahydrate, respectively. The values in the rows for Cr, Co, and Ni indicate the contents of above-described compounds in chromium content equivalent, in cobalt content equivalent, and in nickel content equivalent, respectively.

TABLE 1

| component (g/L) | No. 1 entire period | No. 2 entire period | No. 3 entire period | No. 4 entire period | No. 5 entire period | No. 6 entire period | No. 7 entire period | No. 8 entire period | No. 9 entire period | No. 10 entire period |
|---|---|---|---|---|---|---|---|---|---|---|
| Cr | 3.7 | 3.7 | 3.7 | 3.7 | 3.7 | 3.7 | 3.7 | 3.7 | 3.7 | 3.7 |
| Cr source | nitrate | nitrate | nitrate | nitrate | nitrate | nitrate | nitrate | nitrate | nitrate | nitrate |
| Co | 1.4 | 1.4 | 1.4 | 1.4 | 1.4 | 1.4 | 1.4 | 1.4 | 1.4 | 1.4 |
| diammonium dithiodiglycolate | 4.0 | 4.0 | 4.0 | 4.0 | 4.0 | 4.0 | 4.0 | 4.0 | 4.0 | 4.0 |
| dithioglycolic acid | 0 | 0 | 0 | 0 | 0 | 0 | 0 | 0 | 0 | 0 |
| thioglycolic acid | 0 | 0 | 0 | 0 | 0 | 0 | 0 | 0 | 0 | 0 |
| (1-Hydroxyethane-1,1-diyl)bisphosphonic acid | 0.7 | 0 | 0 | 0 | 0 | 0 | 0 | 0 | 0 | 0 |
| bisodium (1-Hydroxyethane-1,1-diyl)bisphosphonate | 0 | 0.8 | 0 | 0 | 0 | 0 | 0 | 0 | 0 | 0 |
| trisodium (1-Hydroxyethane-1,1-diyl)bisphosphonate | 0 | 0 | 0.9 | 0 | 0 | 0 | 0 | 0 | 0 | 0 |
| tetrasodium (1-Hydroxyethane-1,1-diyl)bisphosphonate | 0 | 0 | 0 | 1.0 | 0 | 0 | 0 | 0 | 0 | 0 |

TABLE 1-continued

| component (g/L) | No. 1 entire period | No. 2 entire period | No. 3 entire period | No. 4 entire period | No. 5 entire period | No. 6 entire period | No. 7 entire period | No. 8 entire period | No. 9 entire period | No. 10 entire period |
|---|---|---|---|---|---|---|---|---|---|---|
| 2-Phosphonobutane1,2,4-tricarboxylic acid | 0 | 0 | 0 | 0 | 1.0 | 0 | 0 | 0 | 0 | 0 |
| aminotrimethylene phosphonic acid | 0 | 0 | 0 | 0 | 0 | 0.5 | 0 | 0 | 0 | 0 |
| pentasodium aminotrimethylene phosphonate | 0 | 0 | 0 | 0 | 0 | 0 | 0.7 | 0 | 0 | 0 |
| pentasodium ethylenediamine tetramethylenephosphonate | 0 | 0 | 0 | 0 | 0 | 0 | 0 | 0.15 | 0 | 0 |
| ethylenediamine tetramethylene phosphonic acid | 0 | 0 | 0 | 0 | 0 | 0 | 0 | 0 | 0.1 | 0 |
| heptasodium diethylenetriamine pentamethylenephosphonate | 0 | 0 | 0 | 0 | 0 | 0 | 0 | 0 | 0 | 0.1 |
| aminotrimethylene phosphonic acid | 0 | 0 | 0 | 0 | 0 | 0 | 0 | 0 | 0 | 0 |
| phosphoric acid | 0 | 0 | 0 | 0 | 0 | 0 | 0 | 0 | 0 | 0 |
| potassium pyrophosphate | 0 | 0 | 0 | 0 | 0 | 0 | 0 | 0 | 0 | 0 |
| pentasodium triphosphate | 0 | 0 | 0 | 0 | 0 | 0 | 0 | 0 | 0 | 0 |
| phosphorous acid | 0 | 0 | 0 | 0 | 0 | 0 | 0 | 0 | 0 | 0 |
| sodium hypophosphite | 0 | 0 | 0 | 0 | 0 | 0 | 0 | 0 | 0 | 0 |
| disodium ethylenediaminetetraacetate | 0 | 0 | 0 | 0 | 0 | 0 | 0 | 0 | 0 | 0 |
| sodium gluconate | 0 | 0 | 0 | 0 | 0 | 0 | 0 | 0 | 0 | 0 |
| oxalic acid | 0 | 0 | 0 | 0 | 0 | 0 | 0 | 0 | 0 | 0 |
| pH | 2.2 | 2.2 | 2.2 | 2.2 | 2.2 | 2.2 | 2.2 | 2.2 | 2.2 | 2.2 |
| treatment temperature (° C.) | 35 | 35 | 35 | 35 | 35 | 35 | 35 | 35 | 35 | 35 |
| treating time (s) | 45 | 45 | 45 | 45 | 45 | 45 | 45 | 45 | 45 | 45 |

TABLE 2

| component (g/L) | No. 11 entire period | No. 12 entire period | No. 13 entire period | No. 14 entire period | No. 15 entire period | No. 16 entire period | No. 17 entire period | No. 18 entire period | No. 19 entire period | No. 20 entire period |
|---|---|---|---|---|---|---|---|---|---|---|
| Cr | 3.7 | 3.7 | 3.7 | 3.7 | 2.5 | 3.1 | 3.5 | 3.7 | 3.7 | 3.7 |
| Cr source | nitrate | nitrate | nitrate | nitrate | chloride | sulfate | acetate | nitrate | nitrate | nitrate |
| Co | 1.4 | 1.4 | 1.4 | 1.4 | 1.4 | 1.4 | 1.4 | 1.4 | 1.4 | 1.4 |
| diammonium dithiodiglycolate | 4.0 | 4.0 | 0 | 0 | 4.0 | 4.0 | 4.0 | 4.0 | 4.0 | 4.0 |
| dithioglycolic acid | 0 | 0 | 4.0 | 0 | 0 | 0 | 0 | 0 | 0 | 0 |
| thioglycolic acid | 0 | 0 | 0 | 4.0 | 0 | 0 | 0 | 0 | 0 | 0 |
| (1-Hydroxyethane-1,1-diyl)bisphosphonic acid | 0 | 0 | 0.7 | 0.7 | 0.7 | 0.7 | 0.7 | 0.7 | 0.3 | 1.5 |
| bisodium (1-Hydroxyethane-1,1-diyl)bisphosphonate | 0 | 0 | 0 | 0 | 0 | 0 | 0 | 0 | 0 | 0 |
| trisodium (1-Hydroxyethane-1,1-diyl)bisphosphonate | 0 | 0 | 0 | 0 | 0 | 0 | 0 | 0 | 0 | 0 |
| tetrasodium (1-Hydroxyethane-1,1-diyl)bisphosphonate | 0 | 0 | 0 | 0 | 0 | 0 | 0 | 0 | 0 | 0 |
| 2-Phosphonobutane1,2,4-tricarboxylic acid | 0 | 0 | 0 | 0 | 0 | 0 | 0 | 0 | 0 | 0 |
| aminotrimethylene phosphonic acid | 0 | 0 | 0 | 0 | 0 | 0 | 0 | 0 | 0 | 0 |
| pentasodium aminotrimethylene phosphonate | 0 | 0 | 0 | 0 | 0 | 0 | 0 | 0 | 0 | 0 |
| pentasodium ethylenediamine tetramethylenephosphonate | 0 | 0 | 0 | 0 | 0 | 0 | 0 | 0 | 0 | 0 |
| ethylenediamine tetramethylene phosphonic acid | 0 | 0 | 0 | 0 | 0 | 0 | 0 | 0 | 0 | 0 |
| heptasodium diethylenetriamine pentamethylenephosphonate | 0 | 0 | 0 | 0 | 0 | 0 | 0 | 0 | 0 | 0 |
| aminotrimethylene phosphonic acid | 0 | 0 | 0 | 0 | 0 | 0 | 0 | 0 | 0 | 0 |
| phosphoric acid | 0 | 0 | 0 | 0 | 0 | 0 | 0 | 0 | 0 | 0 |
| potassium pyrophosphate | 0 | 0.5 | 0 | 0 | 0 | 0 | 0 | 0 | 0 | 0 |
| pentasodium triphosphate | 0.5 | 0 | 0 | 0 | 0 | 0 | 0 | 0 | 0 | 0 |
| phosphorous acid | 0 | 0 | 0 | 0 | 0 | 0 | 0 | 0 | 0 | 0 |

TABLE 2-continued

| component (g/L) | No. 11 entire period | No. 12 entire period | No. 13 entire period | No. 14 entire period | No. 15 entire period | No. 16 entire period | No. 17 entire period | No. 18 entire period | No. 19 entire period | No. 20 entire period |
|---|---|---|---|---|---|---|---|---|---|---|
| sodium hypophosphite | 0 | 0 | 0 | 0 | 0 | 0 | 0 | 0 | 0 | 0 |
| disodium ethylenediaminetetraacetate | 0 | 0 | 0 | 0 | 0 | 0 | 0 | 0 | 0 | 0 |
| sodium gluconate | 0 | 0 | 0 | 0 | 0 | 0 | 0 | 0 | 0 | 0 |
| oxalic acid | 0 | 0 | 0 | 0 | 0 | 0 | 0 | 1.2 | 0 | 0 |
| pH | 2.2 | 2.2 | 2.2 | 2.2 | 2.2 | 2.2 | 2.2 | 2.2 | 2.2 | 2.2 |
| treatment temperature (° C.) | 35 | 35 | 35 | 35 | 35 | 35 | 35 | 35 | 35 | 35 |
| treating time (s) | 45 | 45 | 45 | 45 | 45 | 45 | 45 | 45 | 45 | 45 |

TABLE 3

| | No. 21 | | | No. 22 | No. 23 | No. 24 | No. 25 | No. 26 | No. 27 | No. 28 | No. 29 |
|---|---|---|---|---|---|---|---|---|---|---|---|
| component (g/L) | initial | 50 $dm^2/L$ | 1000 $dm^2/L$ | entire period | entire period | entire period | entire period | entire period | entire period | entire period | entire period |
| Cr | 3.7 | 3.7 | 3.7 | 3.7 | 3.7 | 3.7 | 3.7 | 3.7 | 3.7 | 3.7 | 3.7 |
| Cr source | nitrate | nitrate | nitrate | nitrate | nitrate | nitrate | nitrate | nitrate | nitrate | nitrate | nitrate |
| Co | 1.4 | 1.4 | 1.4 | 1.4 | 1.4 | 1.4 | 1.4 | 1.4 | 1.4 | 1.4 | 1.4 |
| diammonium dithiodiglycolate | 4.0 | 4.0 | 4.0 | 2.5 | 8.0 | 4.0 | 4.0 | 4.0 | 4.0 | 4.0 | 4.0 |
| dithioglycolic acid | 0 | 0 | 0 | 0 | 0 | 0 | 0 | 0 | 0 | 0 | 0 |
| thioglycolic acid | 0 | 0 | 0 | 0 | 0 | 0 | 0 | 0 | 0 | 0 | 0 |
| (1-Hydroxyethane-1,1-diyl)bisphosphonic acid | 0.3 | 1.5 | 4.0 | 0.7 | 0.7 | 0 | 0 | 0 | 0 | 0 | 0 |
| bisodium (1-Hydroxyethane-1,1-diyl)bisphosphonate | 0 | 0 | 0 | 0 | 0 | 0 | 0 | 0 | 0 | 0 | 0 |
| trisodium (1-Hydroxyethane-1,1-diyl)bisphosphonate | 0 | 0 | 0 | 0 | 0 | 0 | 0 | 0 | 0 | 0 | 0 |
| tetrasodium (1-Hydroxyethane-1,1-diyl)bisphosphonate | 0 | 0 | 0 | 0 | 0 | 0 | 0 | 0 | 0 | 0 | 0 |
| 2-Phosphonobutane1,2,4-tricarboxylic acid | 0 | 0 | 0 | 0 | 0 | 0 | 0 | 0 | 0 | 0 | 0 |
| aminotrimethylene phosphonic acid | 0 | 0 | 0 | 0 | 0 | 0 | 0 | 0 | 0 | 0 | 0 |
| pentasodium aminotrimethylene phosphonate | 0 | 0 | 0 | 0 | 0 | 0 | 0 | 0 | 0 | 0 | 0 |
| pentasodium ethylenediamine tetramethylenephosphonate | 0 | 0 | 0 | 0 | 0 | 0 | 0 | 0 | 0 | 0 | 0 |
| ethylenediamine tetramethylene phosphonic acid | 0 | 0 | 0 | 0 | 0 | 0 | 0 | 0 | 0 | 0 | 0 |
| heptasodium diethylenetriamine pentamethylenephosphonate | 0 | 0 | 0 | 0 | 0 | 0 | 0 | 0 | 0 | 0 | 0 |
| aminotrimethylene phosphonic acid | 0 | 0 | 0 | 0 | 0 | 0 | 0 | 0 | 0 | 0 | 0 |
| phosphoric acid | 0 | 0 | 0 | 0 | 0 | 0 | 1.0 | 0 | 0 | 0 | 0 |
| potassium pyrophosphate | 0 | 0 | 0 | 0 | 0 | 0 | 0 | 0 | 0 | 0 | 0 |
| pentasodium triphosphate | 0 | 0 | 0 | 0 | 0 | 0 | 0 | 0 | 0 | 0 | 0 |
| phosphorous acid | 0 | 0 | 0 | 0 | 0 | 0 | 0 | 1.0 | 0 | 0 | 0 |
| sodium hypophosphite | 0 | 0 | 0 | 0 | 0 | 0 | 0 | 0 | 1.0 | 0 | 0 |
| disodium ethylenediaminetetraacetate | 0 | 0 | 0 | 0 | 0 | 0 | 0 | 0 | 0 | 1.0 | 0 |
| sodium gluconate | 0 | 0 | 0 | 0 | 0 | 0 | 0 | 0 | 0 | 0 | 1.0 |
| oxalic acid | 0 | 0 | 0 | 0 | 0 | 0 | 0 | 0 | 0 | 0 | 0 |
| pH | 2.2 | 2.2 | 2.2 | 2.2 | 2.2 | 2.2 | 2.2 | 2.2 | 2.2 | 2.2 | 2.2 |
| treatment temperature (° C.) | 35 | 35 | 35 | 35 | 35 | 35 | 35 | 35 | 35 | 35 | 35 |
| treating time (s) | 45 | 45 | 45 | 45 | 45 | 45 | 45 | 45 | 45 | 45 | 45 |

TABLE 4

| | No. 30 | | | No. 31 | | | No. 32 | | |
|---|---|---|---|---|---|---|---|---|---|
| component (g/L) | initial | 50 $dm^2/L$ | 1000 $dm^2/L$ | initial | 50 $dm^2/L$ | 1000 $dm^2/L$ | initial | 50 $dm^2/L$ | 1000 $dm^2/L$ |
| Cr | 3.7 | 3.7 | 3.7 | 3.7 | 3.7 | 3.7 | 3.3 | 3.3 | 3.3 |
| Co | 1.4 | 1.4 | 1.4 | 0.6 | 0.6 | 0.6 | 0.4 | 0.4 | 0.4 |
| Ni | — | — | — | 2.4 | 2.4 | 2.4 | 1.5 | 1.5 | 1.5 |

TABLE 4-continued

| component (g/L) | No. 30 initial | No. 30 50 $dm^2/L$ | No. 30 1000 $dm^2/L$ | No. 31 initial | No. 31 50 $dm^2/L$ | No. 31 1000 $dm^2/L$ | No. 32 initial | No. 32 50 $dm^2/L$ | No. 32 1000 $dm^2/L$ |
|---|---|---|---|---|---|---|---|---|---|
| diammonium dithiodiglycolate | 0.8 | 0.8 | 0.8 | 2.2 | 2.2 | 2.2 | 0.8 | 0.8 | 0.8 |
| dithioglycolic acid | 0 | 0 | 0 | 0 | 0 | 0 | 0 | 0 | 0 |
| thioglycolic acid | 0 | 0 | 0 | 0 | 0 | 0 | 0 | 0 | 0 |
| (1-Hydroxyethane-1,1-diyl)bisphosphonic acid | 0.7 | 0.7 | 0.7 | 5.4 | 5.4 | 5.4 | 0.7 | 1.2 | 2.1 |
| bisodium (1-Hydroxyethane-1,1-diyl)bisphosphonate | 0 | 0 | 0 | 0 | 0 | 0 | 0 | 0 | 0 |
| trisodium (1-Hydroxyethane-1,1-diyl)bisphosphonate | 0 | 0 | 0 | 0 | 0 | 0 | 0 | 0 | 0 |
| tetrasodium (1-Hydroxyethane-1,1-diyl)bisphosphonate | 0 | 0 | 0 | 0 | 0 | 0 | 0 | 0 | 0 |
| 2-Phosphonobutane1,2,4-tricarboxylic acid | 0 | 0 | 0 | 0 | 0 | 0 | 0 | 0 | 0 |
| aminotrimethylene phosphonic acid | 0 | 0 | 0 | 0 | 0 | 0 | 0 | 0 | 0 |
| pentasodium aminotrimethylene phosphonate | 0 | 0 | 0 | 0 | 0 | 0 | 0 | 0 | 0 |
| pentasodium ethylenediamine tetramethylenephosphonate | 0 | 0 | 0 | 0 | 0 | 0 | 0 | 0 | 0 |
| ethylenediamine tetramethylene phosphonic acid | 0 | 0 | 0 | 0 | 0 | 0 | 0 | 0 | 0 |
| heptasodium diethylenetriamine pentamethylenephosphonate | 0 | 0 | 0 | 0 | 0 | 0 | 0 | 0 | 0 |
| aminotrimethylene phosphonic acid | 0 | 0 | 0 | 0 | 0 | 0 | 0 | 0 | 0 |
| phosphoric acid | 0 | 0 | 0 | 0 | 0 | 0 | 0 | 0 | 0 |
| potassium pyrophosphate | 0 | 0 | 0 | 0 | 0 | 0 | 0 | 0 | 0 |
| pentasodium triphosphate | 0 | 0 | 0 | 0 | 0 | 0 | 0 | 0 | 0 |
| phosphorous acid | 0 | 0 | 0 | 0 | 0 | 0 | 0 | 0 | 0 |
| sodium hypophosphite | 0 | 0 | 0 | 0 | 0 | 0 | 0 | 0 | 0 |
| disodium ethylenediaminetetraacetate | 0 | 0 | 0 | 0 | 0 | 0 | 0 | 0 | 0 |
| sodium gluconate | 0 | 0 | 0 | 0 | 0 | 0 | 0 | 0 | 0 |
| oxalic acid | 0 | 0 | 0 | 3.0 | 3.0 | 3.0 | 1.2 | 1.2 | 1.2 |
| pH | 2.2 | 2.2 | 2.2 | 2.2 | 2.2 | 2.2 | 2.2 | 2.2 | 2.2 |
| treatment temperature (° C.) | 35 | 35 | 35 | 35 | 35 | 35 | 35 | 35 | 35 |
| treating time (s) | 45 | 45 | 45 | 45 | 45 | 45 | 45 | 45 | 45 |

TABLE 5

| component (g/L) | No. 33 initial | No. 33 50 $dm^2/L$ | No. 33 1000 $dm^2/L$ | No. 34 initial | No. 34 50 $dm^2/L$ | No. 34 1000 $dm^2/L$ | No. 35 initial | No. 35 50 $dm^2/L$ | No. 35 1000 $dm^2/L$ |
|---|---|---|---|---|---|---|---|---|---|
| Cr | 3.3 | 3.3 | 3.3 | 3.3 | 3.3 | 3.3 | 3.3 | 3.3 | 3.3 |
| Co | 0.4 | 0.4 | 0.4 | 0.4 | 0.4 | 0.4 | 0.4 | 0.4 | 0.4 |
| Ni | 2.4 | 2.4 | 2.4 | 1.5 | 1.5 | 1.5 | 1.5 | 1.5 | 1.5 |
| diammonium dithiodiglycolate | 2.2 | 2.2 | 2.2 | 0.8 | 0.8 | 0.8 | 1.0 | 1.0 | 1.0 |
| dithioglycolic acid | 0 | 0 | 0 | 0 | 0 | 0 | 0 | 0 | 0 |
| thioglycolic acid | 0 | 0 | 0 | 0 | 0 | 0 | 0 | 0 | 0 |
| (1-Hydroxyethane-1,1-diyl)bisphosphonic acid | 5.4 | 5.8 | 6.5 | 0.7 | 0.7 | 0.7 | 7 | 7 | 7 |
| bisodium (1-Hydroxyethane-1,1-diyl)bisphosphonate | 0 | 0 | 0 | 0 | 0 | 0 | 0 | 0 | 0 |
| trisodium (1-Hydroxyethane-1,1-diyl)bisphosphonate | 0 | 0 | 0 | 0 | 0 | 0 | 0 | 0 | 0 |
| tetrasodium (1-Hydroxyethane-1,1-diyl)bisphosphonate | 0 | 0 | 0 | 0 | 0 | 0 | 0 | 0 | 0 |
| 2-Phosphonobutane1,2,4-tricarboxylic acid | 0 | 0 | 0 | 0 | 0 | 0 | 0 | 0 | 0 |
| aminotrimethylene phosphonic acid | 0 | 0 | 0 | 0 | 0 | 0 | 0 | 0 | 0 |
| pentasodium aminotrimethylene phosphonate | 0 | 0 | 0 | 0 | 0 | 0 | 0 | 0 | 0 |
| pentasodium ethylenediamine tetramethylenephosphonate | 0 | 0 | 0 | 0 | 0 | 0 | 0 | 0 | 0 |

TABLE 5-continued

| component (g/L) | No. 33 initial | No. 33 50 $dm^2/L$ | No. 33 1000 $dm^2/L$ | No. 34 initial | No. 34 50 $dm^2/L$ | No. 34 1000 $dm^2/L$ | No. 35 initial | No. 35 50 $dm^2/L$ | No. 35 1000 $dm^2/L$ |
|---|---|---|---|---|---|---|---|---|---|
| ethylenediamine tetramethylene phosphonic acid | 0 | 0 | 0 | 0 | 0 | 0 | 0 | 0 | 0 |
| heptasodium diethylenetriamine pentamethylenephosphonate | 0 | 0 | 0 | 0 | 0 | 0 | 0 | 0 | 0 |
| aminotrimethylene phosphonic acid | 0 | 0 | 0 | 0 | 0 | 0 | 0 | 0 | 0 |
| phosphoric acid | 0 | 0 | 0 | 0 | 0 | 0 | 0 | 0 | 0 |
| potassium pyrophosphate | 0 | 0 | 0 | 0 | 0 | 0 | 0 | 0 | 0 |
| pentasodium triphosphate | 0 | 0 | 0 | 0 | 0 | 0 | 0 | 0 | 0 |
| phosphorous acid | 0 | 0 | 0 | 0 | 0 | 0 | 0 | 0 | 0 |
| sodium hypophosphite | 0 | 0 | 0 | 0 | 0 | 0 | 0 | 0 | 0 |
| disodium ethylenediaminetetraacetate | 0 | 0 | 0 | 0 | 0 | 0 | 0 | 0 | 0 |
| sodium gluconate | 0 | 0 | 0 | 0 | 0 | 0 | 0 | 0 | 0 |
| oxalic acid | 3.3 | 3.3 | 3.3 | 3.0 | 3.0 | 3.0 | 1.2 | 1.2 | 1.2 |
| pH | 2.2 | 2.2 | 2.2 | 2.2 | 2.2 | 2.2 | 2.2 | 2.2 | 2.2 |
| treatment temperature (° C.) | 35 | 35 | 35 | 35 | 35 | 35 | 35 | 35 | 35 |
| treating time (s) | 45 | 45 | 45 | 45 | 45 | 45 | 45 | 45 | 45 |

TABLE 6

| component (g/L) | No. 36 initial | No. 36 50 $dm^2/L$ | No. 36 1000 $dm^2/L$ | No. 37 initial | No. 37 50 $dm^2/L$ | No. 37 1000 $dm^2/L$ | No. 38 initial | No. 38 50 $dm^2/L$ | No. 38 1000 $dm^2/L$ |
|---|---|---|---|---|---|---|---|---|---|
| Cr | 3.3 | 3.3 | 3.3 | 3.3 | 3.3 | 3.3 | 3.3 | 3.3 | 3.3 |
| Co | 0.4 | 0.4 | 0.4 | 0.4 | 0.4 | 0.4 | 0.4 | 0.4 | 0.4 |
| Ni | 1.5 | 1.5 | 1.5 | 5.2 | 5.2 | 5.2 | 0.09 | 0.09 | 0.09 |
| diammonium dithiodiglycolate | 5.0 | 5.0 | 5.0 | 0.8 | 0.8 | 0.8 | 0.8 | 0.8 | 0.8 |
| dithioglycolic acid | 0 | 0 | 0 | 0 | 0 | 0 | 0 | 0 | 0 |
| thioglycolic acid | 0 | 0 | 0 | 0 | 0 | 0 | 0 | 0 | 0 |
| (1-Hydroxyethane-1,1-diyl)bisphosphonic acid | 0.7 | 0.7 | 0.7 | 0.7 | 0.7 | 0.7 | 0.7 | 0.7 | 0.7 |
| bisodium (1-Hydroxyethane-1,1-diyl)bisphosphonate | 0 | 0 | 0 | 0 | 0 | 0 | 0 | 0 | 0 |
| trisodium (1-Hydroxyethane-1,1-diyl)bisphosphonate | 0 | 0 | 0 | 0 | 0 | 0 | 0 | 0 | 0 |
| tetrasodium (1-Hydroxyethane-1,1-diyl)bisphosphonate | 0 | 0 | 0 | 0 | 0 | 0 | 0 | 0 | 0 |
| 2-Phosphonobutane1,2,4-tricarboxylic acid | 0 | 0 | 0 | 0 | 0 | 0 | 0 | 0 | 0 |
| aminotrimethylene phosphonic acid | 0 | 0 | 0 | 0 | 0 | 0 | 0 | 0 | 0 |
| pentasodium aminotrimethylene phosphonate | 0 | 0 | 0 | 0 | 0 | 0 | 0 | 0 | 0 |
| pentasodium ethylenediamine tetramethylenephosphonate | 0 | 0 | 0 | 0 | 0 | 0 | 0 | 0 | 0 |
| ethylenediamine tetramethylene phosphonic acid | 0 | 0 | 0 | 0 | 0 | 0 | 0 | 0 | 0 |
| heptasodium diethylenetriamine pentamethylenephosphonate | 0 | 0 | 0 | 0 | 0 | 0 | 0 | 0 | 0 |
| aminotrimethylene phosphonic acid | 0 | 0 | 0 | 0 | 0 | 0 | 0 | 0 | 0 |
| phosphoric acid | 0 | 0 | 0 | 0 | 0 | 0 | 0 | 0 | 0 |
| potassium pyrophosphate | 0 | 0 | 0 | 0 | 0 | 0 | 0 | 0 | 0 |
| pentasodium triphosphate | 0 | 0 | 0 | 0 | 0 | 0 | 0 | 0 | 0 |
| phosphorous acid | 0 | 0 | 0 | 0 | 0 | 0 | 0 | 0 | 0 |
| sodium hypophosphite | 0 | 0 | 0 | 0 | 0 | 0 | 0 | 0 | 0 |
| disodium ethylenediaminetetraacetate | 0 | 0 | 0 | 0 | 0 | 0 | 0 | 0 | 0 |

TABLE 6-continued

| component (g/L) | No. 36 initial | No. 36 50 dm²/L | No. 36 1000 dm²/L | No. 37 initial | No. 37 50 dm²/L | No. 37 1000 dm²/L | No. 38 initial | No. 38 50 dm²/L | No. 38 1000 dm²/L |
|---|---|---|---|---|---|---|---|---|---|
| sodium gluconate | 0 | 0 | 0 | 0 | 0 | 0 | 0 | 0 | 0 |
| oxalic acid | 1.5 | 1.5 | 1.5 | 1.2 | 1.2 | 1.2 | 1.2 | 1.2 | 1.2 |
| pH | 2.2 | 2.2 | 2.2 | 2.2 | 2.2 | 2.2 | 2.2 | 2.2 | 2.2 |
| treatment temperature (° C.) | 35 | 35 | 35 | 35 | 35 | 35 | 35 | 35 | 35 |
| treating time (s) | 45 | 45 | 45 | 45 | 45 | 45 | 45 | 45 | 45 |

The terms "nitrate", "chloride", "sulfate", and "acetate" in the row for Cr source in Tables 1 to 3 mean that the water-soluble trivalent chromium compound for the chemical conversion treatment solution shown in the tables was chromium nitrate, chromium chloride, chromium sulfate, or chromium acetate, respectively. All of the water-soluble trivalent chromium compounds for the chemical conversion treatment solutions shown in Tables 4 to 6 were chromium nitrate.

Electrogalvanized steel plates (5 cm×10 cm×1 mm thick, surface area of 1 dm²) obtained with a conventional electroplating process were cleaned by a conventional alkaline cleaning process. After the cleaning process, the plates were washed with water and dried. Each steel plate on which an electroplated layer was formed was immersed for 10 seconds in a nitric acid solution so as to activate the surface of the electroplated layer. The solution contained 3 ml/L of a 67.5% nitric acid solution and was maintained at room temperature. Each test plate after immersion in the nitric acid solution was then washed for 10 seconds with water at room temperature. Each washed test plate was then immersed for 45 seconds into a chemical conversion treatment solution maintained at 35 degrees C., which was selected from above-described prepared chemical conversion treatment solutions shown in Tables 1 to 6. Each test plate in the chemical conversion treatment solution was then pulled out of the solution and washed for 10 seconds with water at room temperature. The washed test plates were dried for 10 minutes at 80±10 degrees C.

The above-described surface treatment including chemical conversion treatment was performed to many steel plates so as to obtain three test plates for evaluation. The first one had a chemical conversion film formed from a chemical conversion treatment solution just after preparation, the second one had a chemical conversion film formed from a chemical conversion treatment solution which was increased in total treated area to 50 dm²/L, and the third one had a chemical conversion film formed from a chemical conversion treatment solution which was increased in total treated area to 1000 dm²/L. When the total treated area was 50 dm²/L, the zinc content of the chemical conversion treatment solution was about 2 g/L. The zinc content of the chemical conversion treatment solution which was increased in total treated area to 1000 dm²/L was about 15 g/L.

In some experiments (experiment numbers 21 and 34), chemical conversion treatment was performed in a manner such that the content of a organic phosphonate compound in the chemical conversion treatment solution was varied in accordance with the total treated area. Specifically, in experiment number 21, the content of the organic phosphonate compound was varied so that the content was initially 0.3 g/L, the content was 1.5 g/L when the total treated area was 50 dm²/L, and the content was 4 g/L when the total treated area was 1000 dm²/L.

(2) Means for Evaluation

A) Color Tone

The blackness of a film formed on each test plate for evaluation was evaluated by measuring the L-value in the reflective mode with a colorimeter (Color meter ZE6000, produced by Nippon Denshoku Industries Co., Ltd.). The evaluation criterion was as follows:

◎(excellent): The L-value of a black film formed from the chemical conversion treatment solution when the total area was 1000 dm²/L was at most 20, ○(very good): The L-value of a black film formed from the chemical conversion treatment solution when the total area was 1000 dm²/L was in the range of more than 20 to at most 26, Δ(good): The L-value of a black film formed from the chemical conversion treatment solution when the total area was 1000 dm²/L was in the range of more than 26 to less than 28, and X(bad): The L-value of a black film formed from the chemical conversion treatment solution when the total area was 1000 dm²/L was in the range of at least 28.

When the L-value is at most 20, the color is normally recognized as jet black. When the L-value is at least 30, the color is often recognized not as black but as gray.

B) Corrosion Resistance

Some test plates for evaluation were subjected to a salt spray test based on a test defined by JIS Z2371. Measurement was performed by observing each test plate for evaluation with the naked eye every 24 hours to check whether white rust had developed on the surface of the test plate. The time at which the coverage of white rust on the surface of the test plate was at least 5% by area was defined as an index of corrosion resistance of the tested plate.

(3) Evaluation Result

The results of the above-described evaluations are shown in Table 7 and 8.

TABLE 7

| Test No. | L-value initial | L-value 50 dm²/L | L-value 1000 dm²/L | jugdement |
|---|---|---|---|---|
| 1 | 19 | 20 | 22 | ○ |
| 2 | 19 | 20 | 22 | ○ |
| 3 | 19 | 20 | 22 | ○ |
| 4 | 19 | 20 | 22 | ○ |
| 5 | 19 | 21 | 23 | ○ |
| 6 | 20 | 23 | 25 | ○ |
| 7 | 20 | 23 | 25 | ○ |
| 8 | 20 | 24 | 25 | ○ |
| 9 | 20 | 23 | 25 | ○ |
| 10 | 20 | 23 | 25 | ○ |
| 11 | 20 | 25 | 28 | X |
| 12 | 20 | 24 | 28 | X |
| 13 | 19 | 20 | 22 | ○ |
| 14 | 18 | 20 | 22 | ○ |

TABLE 7-continued

| Test No. | L-value initial | 50 $dm^2/L$ | 1000 $dm^2/L$ | jugdement |
|---|---|---|---|---|
| 15 | 19 | 20 | 22 | ○ |
| 16 | 18 | 20 | 22 | ○ |
| 17 | 19 | 20 | 22 | ○ |
| 18 | 18 | 20 | 22 | ○ |
| 19 | 18 | 20 | 24 | ○ |
| 20 | 21 | 21 | 22 | ○ |
| 21 | 18 | 20 | 20 | ◎ |
| 22 | 19 | 20 | 22 | ○ |
| 23 | 18 | 20 | 22 | ○ |
| 24 | 20 | 25 | 31 | X |
| 25 | 21 | 26 | 32 | X |
| 26 | 20 | 25 | 30 | X |
| 27 | 19 | 25 | 30 | X |
| 28 | 20 | 26 | 32 | X |
| 29 | 21 | 25 | 31 | X |
| 30 | 19 | 20 | 23 | ○ |
| 31 | 19 | 20 | 22 | ○ |
| 32 | 19 | 20 | 20 | ◎ |
| 33 | 18 | 20 | 20 | ◎ |
| 34 | 19 | 21 | 22 | ○ |
| 35 | 23 | 24 | 26 | ○ |
| 36 | 21 | 21 | 23 | ○ |
| 37 | 19 | 20 | 20 | ◎ |
| 38 | 21 | 25 | 27 | Δ |

TABLE 8

| Test No. | time at which white rust coverage was at least 5% by area (h) initial | 50 $dm^2/L$ | 1000 $dm^2/L$ |
|---|---|---|---|
| 1 | 96 | 120 | 120 |
| 14 | 96 | 120 | 120 |
| 18 | 96 | 120 | 120 |
| 24 | 48 | 24 | 24 |
| 27 | 48 | 24 | 24 |
| 30 | 96 | 120 | 120 |
| 31 | 96 | 120 | 120 |
| 32 | 96 | 120 | 120 |
| 33 | 96 | 120 | 120 |
| 34 | 72 | 96 | 96 |
| 35 | 72 | 96 | 96 |
| 36 | 48 | 72 | 72 |
| 37 | 48 | 72 | 72 |
| 38 | 96 | 120 | 120 |

The invention claimed is:

1. A composition for chemical conversion treatment for use in forming a black film having an L value of less than 28 on a metallic surface of a member, consisting of:

a trivalent chromium-containing substance;

at least one cobalt-containing substance;

at least one sulfur compound, which is an organic compound;

an organic phosphonate compound consisting of one or more compounds selected from the group consisting of organic phosphonic acids, ions of organic phosphonic acids, and organic phosphonates, an additional component selected from the group consisting of nickel-containing compounds; tellurium-containing compounds that release tellurium ions or oxygen acid ions of tellurium; nitrogen-containing compounds; ions of metals selected from the group consisting of Ni, Na, K, Ag, Au, Ru, Nb, Ta, Pt, Pd, Fe, Ca, Mg, Zr, Sc, Ti, V, Mn, Cu, Zn, Sn, Y, Mo, Hf, Te, and W, which may be in a form of oxygen acid ions thereof; aqueous substances containing zinc; substances forming anions of inorganic acids selected from the group consisting of halogen acids, sulfuric acid, sulfurous acid, nitric acid, nitrous acid, and inorganic acids including phosphorous selected from the group consisting of orthophosphoric acid, polyphosphoric acid, metaphosphoric acid, pyrophosphoric acid, ultraphosphoric acid, hypophosphorous acid, and perphosphoric acid; pH adjusting materials selected from the group consisting of sodium hydroxide, sodium hydrogen carbonate, ammonia, sulfuric acid, nitric acid, and hydrochloric acid; surfactants; colorants; pigment-producing agents; desiccants; plastic dispersive materials; dispersants; polyphenols; and combinations thereof; and a solvent selected from the group consisting of water and a combination of water and a water-soluble organic solvent, wherein a content ratio (S/P) of the organic sulfur compound relative to a content of the organic phosphonate compound in the composition is in a range from 0.1 to 10, wherein a content of the trivalent chromium-containing substance in the composition is in a range from 1 to 10 g/L in chromium content equivalent, a content of the cobalt-containing substance in the composition is in a range from 0.1 to 10 g/L in cobalt content equivalent, the content of the sulfur compound in the composition is in a range from 0.1 to 10 g/L, and the content of the organic phosphonate compound in the composition is in a range from 0.1 to 20 g/L, and wherein upon forming the composition as a film onto a metallic surface, the film has an L value of less than 28 when the film is formed by immersing the metallic member in the composition having pH of 2.2 for 45 seconds, and the L value is measured according to JIS Z 8722.

2. The composition according to claim 1, wherein the composition includes at least the nickel-containing compound as the additional component.

3. The composition according to claim 2, wherein the at least one sulfur compound is one or more compounds selected from the group consisting of thioglycolic acid, dithiodiglycolic acid, ions thereof, and salts thereof, and the organic phosphonate compound is one or more compounds selected from the group consisting of (1-hydroxyethane-1,1-diyl)bisphosphonic acid, 2-phosphonobutane1,2,4-tricarboxylic acid, aminotrimethylenephosphonic acid, ethylenediaminetetramethylenephosphonic acid, ions thereof, and salts thereof.

4. The composition according to claim 2, wherein the L-value of the film formed from the composition is less than 28 when a total area of the film formed from the composition is 1000 $dm^2/L$.

5. The composition according to claim 2, wherein a content of the nickel-containing is 0.10 to 10 g/L in nickel content equivalent.

6. A liquid composition for preparing the composition described in claim 5, wherein the liquid composition is a concentrated solution of the composition of claim 5, in the liquid composition, a content of the trivalent chromium-containing substance is in a range from 5 to 150 g/L in chromium content equivalent, a content of the cobalt-containing substance is in a range from 0.5 to 200 g/L in cobalt content equivalent, a content of the nickel-containing substance is in a range from 0.50 to 200 g/L in nickel content equivalent, a content of the sulfur compound is in a range from 0.5 to 200 g/L, and a content of the organic phosphonate compound in the liquid composition is in a range from 0.5 to 400 g/L.

7. The composition according to claim 5, wherein the at least one sulfur compound is one or more compounds selected from the group consisting of thioglycolic acid, dithiodiglycolic acid, ions thereof, and salts thereof, and the organic phosphonate compound is one or more compounds selected from the group consisting of (1-hydroxyethane-1,1-diyl)bisphosphonic acid, 2-phosphonobutane1,2,4-tricarboxylic acid, aminotrimethylenephosphonic acid, ethylenediaminetetramethylenephosphonic acid, ions thereof, and salts thereof.

8. The composition according to claim 5, wherein the L-value of a film formed from the composition is less than 28 when a total area of the film formed from the composition is 1000 $dm^2$/L.

9. The composition according to claim 5, wherein the composition includes at least the aqueous substance containing zinc as the additional component, and a content of the aqueous substance containing zinc is at most 15 g/L in zinc equivalent.

10. The composition according to claim 1, wherein the at least one sulfur compound is one or more compounds selected from the group consisting of thioglycolic acid, dithiodiglycolic acid, ions thereof, and salts thereof; and the organic phosphonate compound is one or more compounds selected from the group consisting of (1 hydroxyethane-1,1-diyl)bisphosphonic acid, 2-phosphonobutane1,2,4-tricarboxylic acid, aminotrimethylenephosphonic acid, ethylenediaminetetramethylenephosphonic acid, diethylenetriaminepentamethylenephosphonic acid, ions thereof, and salts thereof.

11. The composition according to claim 1, wherein the L-value of the film formed from the composition is less than 28 when a total area of the film formed from the composition is 1000 $dm^2$/L.

12. The composition according to claim 1, wherein the composition includes at least the aqueous substance containing zinc as the additional component, a content of the aqueous substance containing zinc in the composition is at most 15 g/L in zinc equivalent.

13. A liquid composition for preparing the composition described in claim 1, wherein the liquid composition is a concentrated solution of the composition of claim 1, in the liquid composition, a content of the trivalent chromium-containing substance is in a range from 5 to 150 g/L in chromium content equivalent, a content of the cobalt-containing substance is in a range from 0.5 to 200 g/L in cobalt content equivalent, and a content of the sulfur compound is in a range from 0.5 to 200 g/L, and wherein the organic phosphonate compound consists of one or more compounds selected from the group consisting of organic phosphonic acids and ions of organic phosphonic acids, and a content of the organic phosphonates in the liquid composition is in a range from 0.5 to 400 g/L.

14. The composition according to claim 1, wherein the at least one sulfur compound is one or more compounds selected from the group consisting of thioglycolic acid, dithiodiglycolic acid, ions thereof, and salts thereof, and the organic phosphonate compound is one or more compounds selected from the group consisting of (1-hydroxyethane-1,1-diyl)bisphosphonic acid, 2-phosphonobutane1,2,4-tricarboxylic acid, aminotrimethylenephosphonic acid, ethylenediaminetetramethylenephosphonic acid, ions thereof, and salts thereof.

15. The composition according to claim 1, wherein the L-value of the film formed from the composition is less than 28 when a total area of the film formed from the composition is 1000 $dm^2$/L.

16. The composition according to claim 1, wherein the composition includes at least the aqueous substance containing zinc as the additional component, and a content of the aqueous substance containing zinc is at most 15 g/L in zinc equivalent.

17. The composition according to claim 1, wherein the composition includes at least the nitric acid or nitrate ions as the additional component.

18. The composition according to claim 1, wherein the film has the L value of less than 25 when a total area of the film formed from the composition is 1000 $dm^2$/L.

19. The composition according to claim 1, wherein a time at which white rust covers at least 5% by area of the metallic surface is at least 72 hours when a total area of the film formed from the composition is 1000 $dm^2$/L, and wherein the time is measured according to JIS Z 2371.

20. The composition according to claim 1, wherein the additional component in the composition is selected from the group consisting of orthophosphoric acid, hypophosphorous acid, the salts thereof, and combinations thereof.

21. The composition according to claim 1, wherein the additional component in the composition is selected from the group consisting of nickel-containing compounds; nitrate ions; orthophosphoric acid, hypophosphorous acid, and the salts thereof; and the pH adjusting material selected from the group consisting of sodium hydroxide, sodium hydrogen carbonate, ammonia, sulfuric acid, nitric acid, and hydrochloric acid; and combinations thereof.

22. A process for producing a member having a black film, the process comprising a step of contacting the composition described in claim 1 with a metallic surface of a member so as to form a film on the surface of the member, wherein the film formed on the metallic surface has an L value of less than 28 when the film is formed by immersing the metallic member in the composition having pH of 2.2 for 45 second, and the L value is measured according to JIS Z 8722.

23. The process according to claim 22, wherein the content of the organic phosphonate compound in the composition is increased as a total area of the film formed from the composition increases.

* * * * *